United States Patent [19]

Landis

[11] 4,418,833

[45] Dec. 6, 1983

[54] LARGE VOLUME CONTAINER WITH GASKETLESS SEAL

[75] Inventor: H. Richard Landis, Oak Lawn, Ill.

[73] Assignee: Landis Plastics Inc., Chicago Ridge, Ill.

[21] Appl. No.: 330,194

[22] Filed: Dec. 14, 1981

[51] Int. Cl.[3] ..... B65D 41/16; B65D 41/18

[52] U.S. Cl. ..... 220/306; 215/DIG. 1

[58] Field of Search ..... 220/306, 307, DIG. 19; 150/0.5; 215/DIG. 1, 317

[56] References Cited

U.S. PATENT DOCUMENTS

| | | | |
|---|---|---|---|
| 3,428,208 | 2/1969 | Kosar | 215/DIG. 1 |
| 3,770,156 | 11/1973 | Yates, Jr. | 215/DIG. 1 |
| 4,349,119 | 9/1982 | Letica | 220/306 |

*Primary Examiner*—George T. Hall

*Attorney, Agent, or Firm*—Fitch, Even, Tabin & Flannery

[57] ABSTRACT

A large volume container and a closure therefor interlock and form a gasketless seal which will withstand a substantial drop of the filled container assembly. A rim portion of the closure provides an annular recess which receives the upper rim of the container, and interlocking members of the rim portion and the rim effect a snap-fit of the closure to the container. A sealing bead projects upwardly of the container rim and a pair of annular sealing flanges depend from the upper end of the recess, and when the rim is received in the recess, the sealing bead extends between, spreads apart and seals with both the inner and outer sealing flanges.

2 Claims, 8 Drawing Figures

LARGE VOLUME CONTAINER WITH GASKETLESS SEAL

The present invention relates to containers formed of semi rigid material, and more particularly to containers for voluminous weighty contents which have snap-on closures.

Previously, voluminous weighty liquids such as paints were generally distributed in metal cans. More recently, containers for paint and the like have been formed of resiliently flexible plastics which are cheaper to produce and which are lighter weight. Generally, paint containers have snap-on closures which are pried off for access to the contents and reapplied thereafter if any of the contents remain. An important requirement of paint containers is that they are easily resealable to preserve the unused contents and a seal must be formed even if the contents coat the sealing surfaces.

The closure of a paint container not only must form a complete airtight seal with the container to prevent the deterioration of the contents, i.e., premature hardening of the paint, but the seal must remain intact through rough handling of the paint-filled container. The industrial standard for paint containers is that they may be dropped from a four foot height onto a hard surface without spilling the contents.

As one means of achieving a secure seal which survives a four foot drop of the container, closures have been designed with rim portions having inverted U-shaped recesses to receive upper lips of containers and sealing gaskets seated between the lips and the upper ends of the recesses. Although sealing gaskets individually are relatively inexpensive, the cost of such gaskets add up to a significant expense when filling large numbers of containers. It is therefore desirable to eliminate, if possible, the need for such a gasket.

Molded gasketless closure assemblies have been described in U.S. Pat. Nos. 4,165,020, 4,182,475 and 4,209,104. Because semi rigid plastics of which such containers are formed are substantially more rigid than resilient compressible gaskets used for sealing containers, it is more likely that an incomplete seal will be formed in gasketless containers if the sealing members are slightly misshapen.

A further cause of sealing failure may be the result of differential pressures caused by charging the containers with hot material and closing the same while hot with the result that subsequent cooling causes differential pressures acting on the seal and may result in failure of the seal.

It is a primary object of the present invention to provide a container with a gasketless closure which securely seals the container and maintains this seal even if the container, charged with voluminous weighty material, is dropped a substantial distance or otherwise mishandled. Further, it is an object of this invention to provide a seal which will not be susceptible to leaking because of pressure changes resulting from hot filling of the container.

A container and closure are provided having interlocking means which secure of the closure on the container. The upper rim of the container has an upwardly projecting bead which is received between an inner and an outer sealing flange depending form a rim portion of the closure. When the closure is applied to the container, the bead spreads apart the flanges, and a secure double seal is formed along the bead.

These and other objects and advantages of the invention will become more apparent from the following detailed description of the invention in reference to the accompanying drawings in which.

Figure 1:
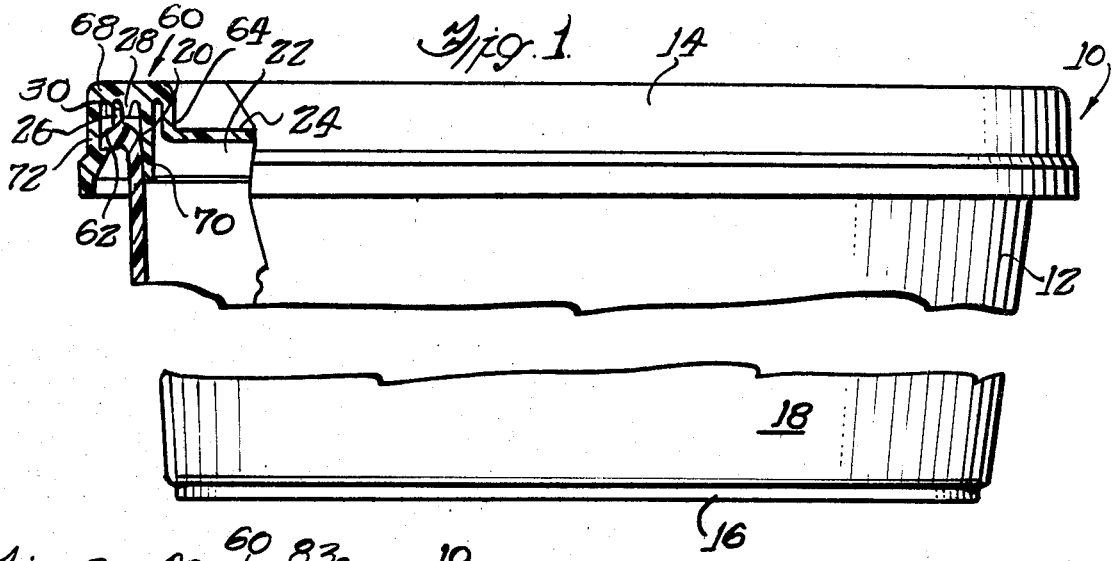
FIG. 1 is an elevation view, partially cut away, of a container-closure assembly embodying various features of the present invention.

A container and closure assembly 10 for holding a large volume includes a container 12 and a snap-on closure 14. The container 12 and closure 14 are each preferably formed of a resiliently flexible polymeric material such as high density polyethylene. The container 12 has a circular bottom wall 16 and an encircling container wall 18 having an upper rim 20 bounding an open end 22. The closure 14 has a top wall 24 for covering the open end 22 of the container 12.

In accordance with the present invention, the large-size container assembly 10, such as, for example, a five-gallon pail, may be formed to provide the necessary sealing between the closure 14 and container 12 without the separate gasket commonly carried within the closure rim portion for sealing engagement with the rim of the container. The elimination of the gasket is achieved by use of a sealing means which includes an annular sealing bead 26 on the container rim which projects and spreads a pair of depending sealing flanges 28, 30 on the closure 14. The depending sealing flanges 28, 30 are annular in shape with an inner sealing flange 28 being deflected radially inward by the sealing bead 26 and an outer sealing flange 30 being deflected radially outward by the bead. An internal pressure above ambient within the container assembly 10 will force the inner sealing flange 28 more tightly against the inner facing side 32 of the bead 26. On the other hand, if there is a vacuum in the container assembly 10, the positive pressure differential acting against the outer sealing flange 30 forces it against the outer facing side 34 of the sealing bead 26. If the manufacturing process is such that one or the other sealing flanges 28, 30 is not positioned for good sealing contact, then the other flange should be in position to provide the necessary sealing action with the sealing bead 26. In the usual case, the sealing bead 26 is tapered and spreads both the sealing flanges 28, 30 to assure that the closure 14 seals despite slight variations in the radial or axial dimensions of the interlocking portions of the container 12 and closure 14.

Figure 5:
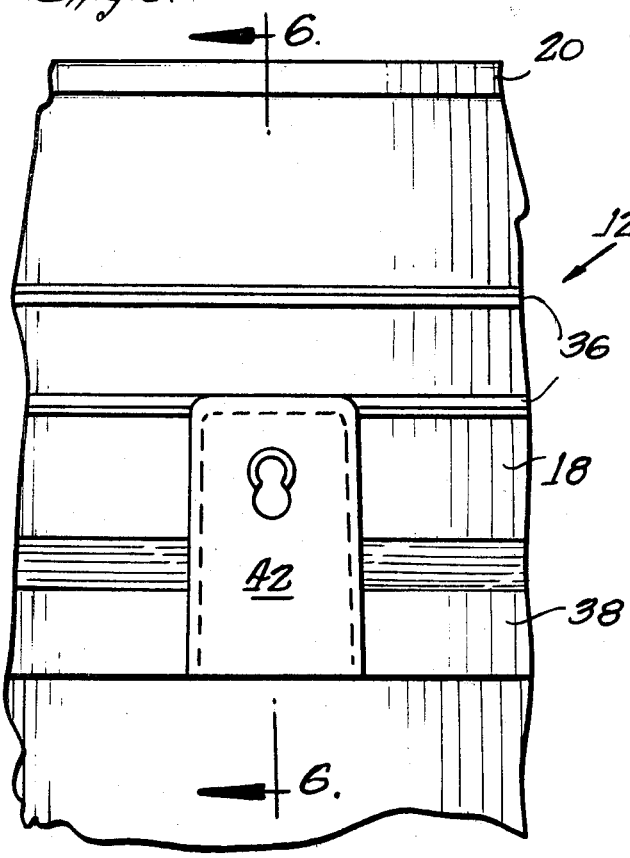
FIG. 5 is an elevation view of the upper portion of the container.

The encircling container wall 18 is frustoconical expanding in diameter slightly from the bottom wall 16 upward. As illustrated in FIG. 5, a pair of annular reinforcement rings 36 extend outwardly of the container wall 18, and, along with the thickened rim 20, provide additional rigidity to the container wall at its upper end.

Figure 6:
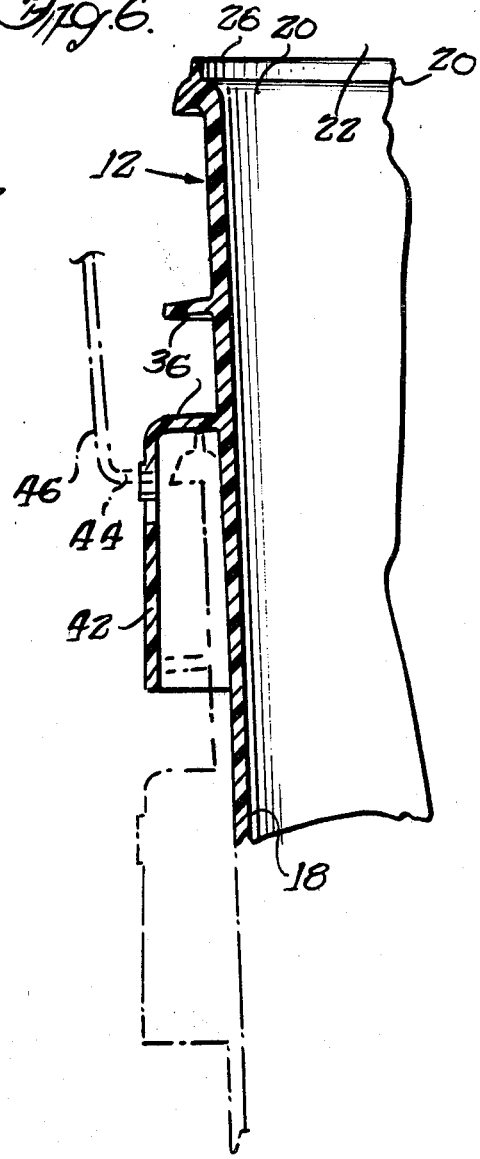
FIG. 6 is a cross-sectional view taken along line 6—6 of FIG. 5.
Figure 7:
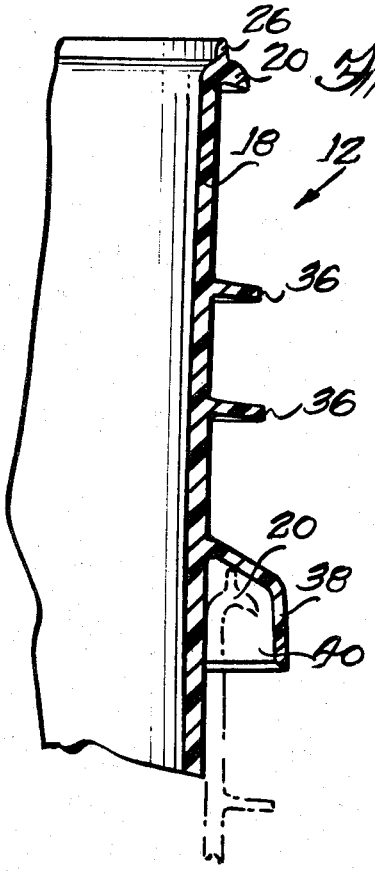
FIG. 7 is a cross-sectional view similar to that of FIG. 6 taken along a line through another portion of the container.

An annular L-shaped bumper ring 38, disposed below the reinforcement rings 36, provides a stacking facility which includes a recess 40 (FIG. 7) which loosely receives the upper rim 20 of another container 12 when the empty containers are stacked for storage and shipping. At diametrically opposite locations, a pair of apertured rings 42 (FIGS. 5,6) extend between the lowermost support flange 36 and the bumper ring 38, and hooked ends 44 of a carrying handle 46 (FIG. 6) extend into the apertured rings.

The thickened upper rim 20, which extends outward of the container wall 18, provides the interlocking and sealing surfaces of the container 12. A flat lower surface 48 (FIG. 3) of the rim 20 extends from the outer surface 50 of the container wall 18 and is slightly downturned for interlocking with an upwardly facing surface 52 of the closure 14 as described in greater detail hereinafter. The sealing bead 26, which extends upwardly from the generally arcuate upper surface 54 of the rim 20, is tapered for wedging apart the annular sealing flanges 28, 30 and includes the inner and outer sides 32, 34 and a rounded upper free end 58, the sides converging at substantially equal angles relative to a vertical centerline 56 (FIG. 2).

Figure 4:
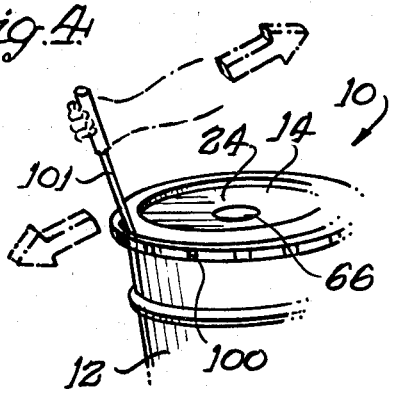
FIG. 4 is a perspective view of the assembly illustrating prying of the closure from the container.

The closure 14 is an integrally formed piece and consists of the generally flat top wall 24 and a rim portion, indicated generally at 60, which provides a recess 62 that receives the container rim 20 as well as interfitting and sealing surfaces. The rim portion 60 is connected to the top wall 24 by an upstanding annular flange 64 with the rim portion 60 being above the top wall 24 and with the container rim 20 being generally horizontally aligned with the top wall 24 in the closed assembly 10. The upstanding flange 64 as well as a domed central portion 66 (FIG. 4) also provide additional rigidity to the top wall 24.

The rim portion 60, which receives the container rim 20, includes an upper annular ring 68 extending generally horizontally from the upper edge of the upstanding flange 64 and an inner skirt 70 and an outer skirt 72 depending therefrom. The outer skirt 72, inner skirt 70 and upper ring 68 define the annular recess 62 having a vertical inner surface 74, a horizontal upper surface 76 and a vertical outer surface 78 (FIG. 2).

Figure 2:
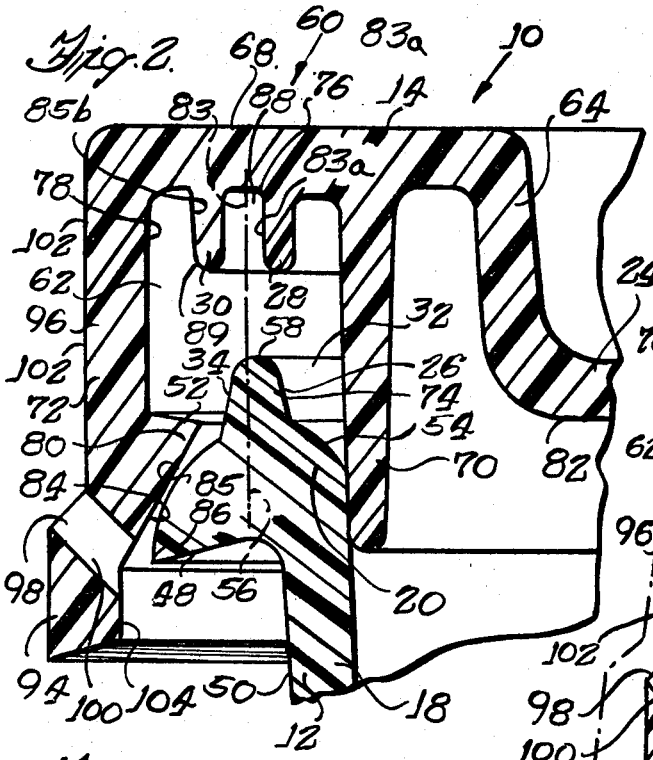
FIG. 2 is a enlarged cross-sectional view of the container rim and closure rim portion just prior to application of the closure to the container.
Figure 3:
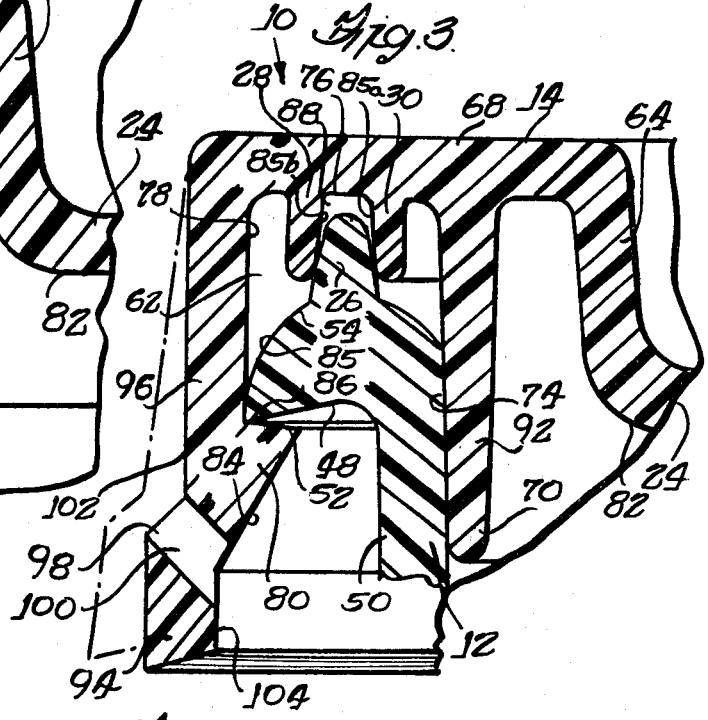
FIG. 3 is a cross-sectional view similar to FIG. 2 showing the closure applied to the container.

As best seen in FIG. 2, the upwardly facing surface 52, which interlocks with the downturned surface 48 of the container rim 20, is formed on the upper and inner side of an annular bead 80 which projects radially inwardly of the vertical surface 78 thereabove. The upwardly facing or interlocking surface 52 of the locking bead 80 is generally horizontal and inclined slightly downwardly to serve a camming function when the closure 14 is snapped onto the container 12. As can be seen in FIG. 3, the interlocking surface 52 is generally at the horizontal level of the under surface 82 of the top wall 24.

Airtight sealing is achieved when the inner and outer sealing flanges 28, 30 receive the upwardly projecting sealing bead 26 and are flexed inwardly and outwardly respectively by the bead. The sealing flanges 28, 30 herein are in the form of rings integrally formed and depending from the upper surface 76 of the annular groove 62 and are spaced apart generally equidistant from a centerline 83 (FIG. 2) of the groove. Each sealing flange 28, 30 has substantially vertical facing sealing surfaces **85*a* and 85*b* (FIG. 2) and a rounded lower end 89. The centerline 56 (FIG. 2) of the annular sealing bead 26 and the centerline 83 between the sealing flanges 28, 30 are equal radial distances from the axes of the container 12 and closure 14. To facilitate application of the closure and sealing engagement, the distance between the facing sealing surfaces 85*a*, 85*b* of the sealing flanges 28, 30 is larger than the width of upper end 58 of the sealing bead 26 so that the upper end readily enters a groove 88 defined between the sealing flanges. The lower portions of the bead 26 is of a greater width than the groove and abuts and spreads the flanges 28 and 30. The sealing flanges 28, 30 are resilient and have a downward dimension substantially greater than their cross-section thickness whereby they may be easily deflected by the sealing bead 26**.

When the closure 14 is snapped onto the container 12 with a downward pressure on the closure, a downwardly and outwardly inclined surface 84 of the locking bead 80 cams over an outer arcuate wall 85 (FIG. 2) of the container rim 20 causing the skirt 72 to deflect outwardly until the locking bead 80 locates below an edge 86 of the rim 20 whereat the resilient outer skirt snaps back thereby locating the rim edge 86 at the juncture of the surface 52 and vertical surface 78. As the closure 14 is applied, the upper end 58 of the sealing bead 26 penetrates into the groove or channel 88 between the facing surfaces **85*a*, 85*b* of the inner and outer sealing flanges 28, 30. As the sealing bead 26 is pushed fully into the channel 88, the thicker lower portion of the sealing bead 26 abuts the sealing flanges 28, 30 spreads them apart and seals therewith. As best seen in FIG. 3, both the inner and outer sides 32, 34 of the sealing bead 26 seal with the respective facing surfaces 85*a*, 85*b* of the resilient flanges 28, 30**.

The double sealing arrangement, with one sealing flange 28 pressing against the inner side 32 of the sealing bead 26 and one sealing flange 30 pressing against the outer side 34, serves to maintain a seal along the bead when the pressure in the container assembly 10 is higher or lower than ambient pressure as may occur when the container assembly is charged with hot material. When the closure 14 is applied to the container 12 while the contents are still hot, pressure may build up within the closed assembly 10. Such pressure acts against the inwardly deflected inner sealing flange 28 and enhances the sealing pressure between the inner sealing flange and the inner side 32 of the bead 26. Later, when the contents cool to ambient temperature, the pressure in the container assembly 10 decreases and may become lower than the ambient pressure, i.e., a partial vacuum may develop within the container assembly 10. A reduced interior pressure relative to the ambient pressure applies force to urge outer sealing flange 28 inward and increase the sealing force of the outer sealing flange against the outer side 34 of the bead. Accordingly, one or the other of the seals in the double sealing arrangement is aided by an unequal pressure whether the internal pressure is higher or lower that the ambient pressure.

The double sealing arrangement also provides redundancy, increasing the likelihood that at least one seal will be formed. As may sometimes occur during molding, either the container 12 or closure 14 may be slightly out of round. If either of the sealing flanges 28, 30 or the sealing bead 26 is slightly out of round, a complete seal may not form along one side of the bead; however, it is likely that the other flange 28, 30 will press even more tightly against the bead 26 and form a complete seal with the corresponding side 32 or 34 of the bead.

In addition to pressing inwardly against the bead 26 to seal therewith, the spread sealing flanges 28, 30 have a memory and want to return to their unflexed state by sliding upward and hence there will be exerted a vertical force component against the bead, similar to the action of a resilient gasket against the upper rim of a container. The vertical force component against the bead 26 raises the closure 14 until the interlocking surface 52 of the rim 20 presses firmly against the interlocking surface 48 of the rim portion 20. Because the bead 26 is tapered so that a substantial portion of the bead 26 is thicker than the distance between the facing surfaces 85*a*, 85*b* of the flanges 28, 30, the axial dimensions of the flanges and of the bead are not critical, and a secure snap-fit and seal will be obtained despite slight variations in size of the interlocking and sealing members.

When the cover is locked, the locking surfaces 48 and 52 abut each other and are under some pressure sufficient to provide a secondary seal therebetween. An additional secondary seal may be formed as the vertical skirt 70 on the closure abuts and slides the upper and inner wall of the container. More specifically, an inner surface 92 of the container 12 and the inner surface 74 of the flange 70 abut as the frusticonical container wall 18 deflects the vertical inner skirt 70 slightly inward (as seen in ghost in FIG. 2) when the closure 14 is applied.

The interlock and sealing are sufficient to withstand a four foot drop even of a large, filled container assembly 10 such as a five gallon paint pail. Interlocking arrangements similar to that described herein have been successfully used in gasket type containers to easily pass a four foot drop test, and the memory of the resilient sealing flanges 28, 30 is sufficient to exert a vertical pressure against the sealing bead 26 comperable to that of a gasket.

To facilitate removal of the closure 14 from the container 12, the skirt 72 extends below the locking head 80 and has an apertured ring 94 by which a prying instrument 101 (FIG. 4) may be applied. The ring 94 is the lowermost segment of the closure skirt 72 (FIGS. 2, 3) and it is connected to an upper segment 96 by a short flared central segment 98. A plurality of slits 100 extend through the central segment for insertion of a prying tool 101.

The closure 14 is easily removed with a prying tool 101 such as a screwdriver. The tool 101 is inserted from above in one of the slits 100. By prying the tool 101 against the outer surface 102 of the upper segment 96 of the outer skirt 72 and the inner surface 104 of the lower ring 94, at least a portion of the locking bead 80 is displaced outward of the rim 20 permitting the closure 14 to be lifted from the container 12. The container-closure assembly 10 will reseal even after it has been opened and the contents, e.g., paint, has formed a film on parts of the locking and sealing surfaces, providing that the film is sufficiently deformable.

By way of example, the closure 14 may have an outer diameter of about 12 11/64 inches with the central cover 24 having a diameter of about 10.5 inches. The bead 26 may be located at its centerline on an 11.555 diameter and the flanges 28 and 30 may be spaced apart at 0.150 inch between the respective centers of the flanges. Each flange 28 and 30 may have 0.050 inch thickness and 0.144 inch axial length. The bead 26 may have a 0.050 inch radius surface 58 with its surfaces 32 and 34 each inclined at 10° to the vertical.

Among the advantages of the container assembly 10 of the present invention is that it may be formed from molds which are simple adaptations of molds used to form container assemblies which require a gasket seated in an annular recess. In such gasket-type containers, sufficient clearance is provided between the container rim and the upper wall of the recess for seating the resilient, compressible gasket. Molds for such containers may be modified by providing a trough-shaped depression in the rim-forming portion of a mold used to form the container and a pair of trough-shaped depressions in the recess-forming portions of a mold used to form the closure.

Figure 8:
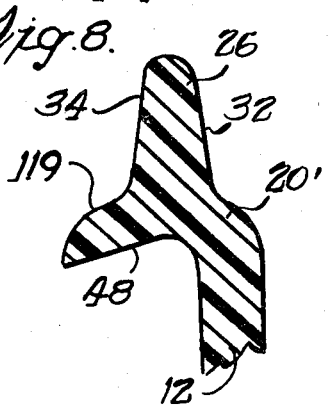
FIG. 8 is an alternate configuration of the rim of the container.

Illustrated in FIG. 8 is an alternative embodiment of the container assembly 10 in which the rim 20' of the container member 12 is formed with a shoulder 119 from which the sealing bead 26 projects. Such a rim 20' has the advantage of being formed with less material.

Although the invention has been described in terms of certain preferred embodiments, modifications obvious to one with ordinary skill in the art may be made without departing from the scope of the invention. The particular interlocking means are not limited to that described hereinabove, but the invention is intended to include other designs of interlocking means which secure a closure with a container and which maintain the secured condition when the filled container-closure assembly is dropped. While it is generally preferred that the container as well as the closure be formed of resiliently deformable material, the container may be formed of rigid material so long as the closure is sufficiently resiliently deformable to provide the seal.

Various features of the invention are set forth in the following claims.

What is claimed is:

1. A plastic molded container and closure assembly for holding large volume contents comprising:

a container having an encircling container wall, an annular rim on an upper open end of said container wall;

a one-piece closure molded of resilient flexible plastic material having a top wall for covering the open end of the container wall;

an interlocking flexible bead on said closure and a rigid bead on said container for interlocking engagement with each other to secure the closure onto the container;

an annular sealing bead on said rim projecting upwardly;

inner and outer sealing flanges on said closure depending from the underside of said closure, said sealing flanges being spaced apart a predetermined distance to receive and to abut said sealing bead when said closure is secured onto said container;

said sealing bead being tapered in an upward direction to a rounded free end, said sealing bead being centered between said sealing flanges and having a width greater than said predetermined distance for being abutted by said flanges and for spreading said flanges in a radial direction;

said inner and outer sealing flanges being depending rings integral with a top rim portion of said closure and being substantially longer in their downward direction than in their cross-section thickness for easy deflection by the sealing bead and for deflection by internal or external pressure to more tightly abut a side of said sealing bead.

2. A container enclosure assembly in accordance with claim 1 in which said inner and outer sealing flanges have substantially parallel vertical side walls, and in which said sealing bead has tapered side walls extending at an angle of about 10 degrees to the vertical.

* * * * *